US006419573B1

(12) United States Patent
Lise et al.

(10) Patent No.: US 6,419,573 B1
(45) Date of Patent: Jul. 16, 2002

(54) SANDING SPONGE WITH HIGH TEAR STRENGTH BACKING LAYER

(75) Inventors: Jonathan M. Lise, Woodbury; Chris A. Minick, Stillwater, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/458,166

(22) Filed: Dec. 9, 1999

(51) Int. Cl.[7] ..... B24D 11/00

(52) U.S. Cl. ..... 451/533; 451/534; 451/539; 451/532; 15/118

(58) Field of Search ..... 451/533, 534, 451/539, 532; 51/297, 295, 296, 298, 293, 302, 303, 307, 308, 309; 15/118, 229.11, 208, 210.1, 211

(56) References Cited

U.S. PATENT DOCUMENTS

| | | | | | |
|---|---|---|---|---|---|
| 3,653,859 | A | * | 4/1972 | Zimmer et al. | 451/533 |
| 4,714,644 | A | * | 12/1987 | Rich | 428/136 |
| 4,893,436 | A | | 1/1990 | Rich | |
| 5,560,753 | A | * | 10/1996 | Schnabel et al. | 51/295 |
| 5,609,513 | A | * | 3/1997 | Stark | 451/59 |
| 5,924,917 | A | * | 7/1999 | Benedict et al. | 451/526 |
| 5,947,807 | A | | 9/1999 | Overseth | |
| 6,059,850 | A | * | 5/2000 | Lise et al. | 51/297 |

FOREIGN PATENT DOCUMENTS

| | | |
|---|---|---|
| EP | 0 638 392 | 2/1995 |
| WO | WO 00 03840 A | 1/2000 |

OTHER PUBLICATIONS

Advertising (1 page) obtained from Crest Foam Industries over the internet at http://www.crestfoam.com/buss102new.html on Dec. 7, 1999, entitled "Crest Foam Industries, Inc. Expanding technology for an expanding world".

Advertising (3 pages) obtained from Crest Foam Industries over the internet at http://www.crestfoam.com/applications/marketing.html on Dec. 7, 1999, entitled Feltcrest™ compressed reticulated polyurethane foam.

Advertising (1 page) from Minnesota Mining And Manufacturing Company (3M) describing sanding sponges that have been on sale for more than a year prior to the filing date of the subject application, entitled "3M™ Sanding Sponges", Product 410S, UPC No. 048011–16404.

A.S.T.M. test method ASTM D 3574–95 entitled "Standard Test Methods for Flexible Cellular Materials—Slab, Bonded and Molded urethane Foams".

* cited by examiner

*Primary Examiner*—George Nguyen
(74) *Attorney, Agent, or Firm*—William L Huebsch

(57) ABSTRACT

A resilient flexible sanding sponge including a foam backing layer having a layer of abrasive particles distributed along one of its major surfaces that are adhered together and to the backing layer by a layer of flexible adhesive material. That backing layer has about the same flexibility and conformability as the backing layers on prior art sanding sponges, while having a significantly higher tear strength than prior art sanding sponges. That high tear strength backing layer can either be (1) a layer of felted urethane foam; or (2) a layer of foam that encompasses a reinforcing material. When the backing layer is of felted urethane foam the layer of flexible adhesive material can have a major structurally sound portion below the surface along which the layer of abrasive particles is positioned and a minor portion adhering the abrasive particles along that surface to leave large portions of the abrasive particles projecting above the layer of adhesive material where they can effectively abrade a surface over which the sanding sponge is rubbed.

14 Claims, 2 Drawing Sheets

SANDING SPONGE WITH HIGH TEAR STRENGTH BACKING LAYER

FIELD OF THE INVENTION

The present invention relates to resilient flexible abrading devices of the type sometimes called sanding sponges that each comprise a thin backing layer of foam and includes a layer of abrasive particles adhered together and to the backing layer by a layer of flexible adhesive.

BACKGROUND OF THE INVENTION

Resilient flexible sanding sponges that comprise a thin backing layer (e.g., about 3/16 inch or 0.5 cm thick) of urethane foam and include a layer of abrasive particles adhered together and to the foam backing layer along one of its major surfaces by a layer of flexible adhesive are well known in the prior art. One such sanding sponge is commercially available from Minnesota Mining and Manufacturing Company, St. Paul, Minn. under the trade designation "Softback Sanding Sponge". Typically, a user of that sanding sponge places the surface of the backing layer opposite the abrasive against the palm of his or her hand and rubs the abrasive over a surface to be abraded while conforming the layer of abrasive to the surface being abraded. While such sanding sponges work quite well to abrade objects having parallel surfaces, their backings are too easily torn when they are used to abrade the intersecting surfaces of projections such as the corners of a table top. Hand pressure on the sanding sponge can cause such a projection to penetrate and tear the backing layer of the sanding sponge as it is moved over the projection. With previously used methods for forming the urethane foam backing, the tear strength of that backing has been largely a function of the urethane chemistry used in making the foam. Obtaining a high tear strength for the backing has been difficult, often requiring a great deal of experimentation, experience and luck; and the maximum tear strengths obtained have still been less than those that are desired.

Also, the layer of flexible adhesive in such a sanding sponge that adheres the layer of abrasive particles together and to the foam backing layer along one of it major surfaces must have sufficient integrity and adhesion to the abrasive particles and to the foam backing layer so that it will not break, or release the abrasive particles, or release from the foam backing layer as the resilient flexible sanding sponge is conformed and used to abrade a surface. Such integrity is provided by applying a layer of adhesive material that has a major portion overlaying the major surface of the backing layer to which it is adhered (in which major portion the abrasive particles are imbedded), and only has tentacle like portions extending into the cells open to that major surface of the foam backing layer to attach the adhesive layer to the foam. While such a layer of flexible adhesive material can provide the desired integrity and adhesion to the abrasive particles and to the foam backing layer, its major portion that overlays the major surface of the backing layer is sufficiently thick that it envelopes more of the abrasive particles than might be desired, thereby somewhat restricting the ability of the abrasive particles to abrade a surface over which the sanding sponge is rubbed.

DISCLOSURE OF THE INVENTION

The present invention provides a resilient flexible sanding sponge having a thin backing layer that is about as flexible and conformable as the urethane backing layers on known prior art sanding sponges while providing significantly improved tear strength compared to the backing layers of those prior art sanding sponges.

The sanding sponge according to the present invention includes a foam backing layer having a layer of abrasive particles along one of its major surfaces that are adhered together and to that backing layer by a layer of flexible adhesive material. The backing layer, when measured in accordance with A.S.T.M. test method ASTM D 3574-95, has a compression force deflection of less than 4 pounds per square inch (64 kPa) at 50% deflection (as do prior art sanding sponges) to provide good conformability with a surface being abraded, while having a tear strength of at least 5 pounds per inch (880 Newtons per meter) which gives the sanding sponge significantly improved tear resistance compared to known prior art sanding sponges so that the sanding sponge will not be easily torn when it is used to abrade projections.

That high tear strength backing layer can be provided by using for the backing layer either (1) felted urethane foam; or (2) foam that encompasses a layer of reinforcing material between its major surfaces. Felted urethane foam having a compression ratio of at least 2, and preferably having a compression ratio in the range of about 3 to 4 is useful as the backing layer. Felted urethane foams having compression ratios above 4 could also be useful as the backing layer, however, increasing the compression ratio increases both the stiffness and the cost of the backing layer.

When the backing layer of the sanding sponge is of felted urethane foam it can also encompass a major portion of the layer of flexible adhesive material adhering the layer of abrasive particles together along its surface to provide the needed structural integrity, adhesion to the abrasive particles and adhesion to the foam backing layer that is required of the layer of adhesive material so that it will not break, or release the abrasive particles, or release from the foam backing layer as the sanding sponge is conformed to a surface and used to abrade it, while leaving large portions of the abrasive particles projecting above the layer of adhesive material where they can effectively abrade a surface over which the sanding sponge is rubbed.

Sanding sponges are typically made by coating liquid make coat adhesive over one major surface of the backing layer, coating a layer of the abrasive particles on the adhesive coated surface of the backing layer, and then drying the adhesive. When the backing layer is of felted foam, more of that layer of make coat adhesive will be wicked into and adsorbed in the backing layer than when the backing layer is a layer of non-felted urethane foam, apparently because of the smaller cell size and crushed cell walls of the felted foam. This greater adsorption of the make coat adhesive has several desirable effects. (1) It forms a major structurally sound portion of the layer of flexible adhesive below the surface of the backing layer along which the layer of abrasive particles is adhered (i.e., the portion of the layer of flexible adhesive below the surface of the backing layer is firmly adhered to the cell walls of the foam backing layer and has very few voids that could weaken its structural integrity). (2) Wicking of the make coat adhesive into the felted urethane foam backing material causes the adhesive to draw backing from around the abrasive particles while leaving meniscuses of the adhesive around the abrasive particles to hold them in place, thereby exposing a higher percentage of the abrasive particles for contact with a surface to be abraded than is exposed if less of the make coat adhesive is wicked into the backing layer. Also, (3) wicking of the make coat adhesive into the felted urethane foam backing material appears to cause most of the abrasive particles to become supported closely along the surface of the backing layer (rather than having some abrasive particles supported on portions of the layer of adhesive of different thicknesses as appears to be the case with prior art sanding sponges), thereby providing an outer surface defined by the ends of the abrasive particles opposite the backing layer that is almost as smooth as the surface of the backing layer along which the abrasive particles are adhered, and which appears to be more smooth than the surfaces defined by the tips of the abrasive particles on prior art sanding sponges.

BRIEF DESCRIPTION OF THE DRAWING

The present invention will be further described with reference to the accompanying drawing wherein like reference numerals refer to like parts in the several views, and wherein.

DETAILED DESCRIPTION OF THE INVENTION

Figure 1:
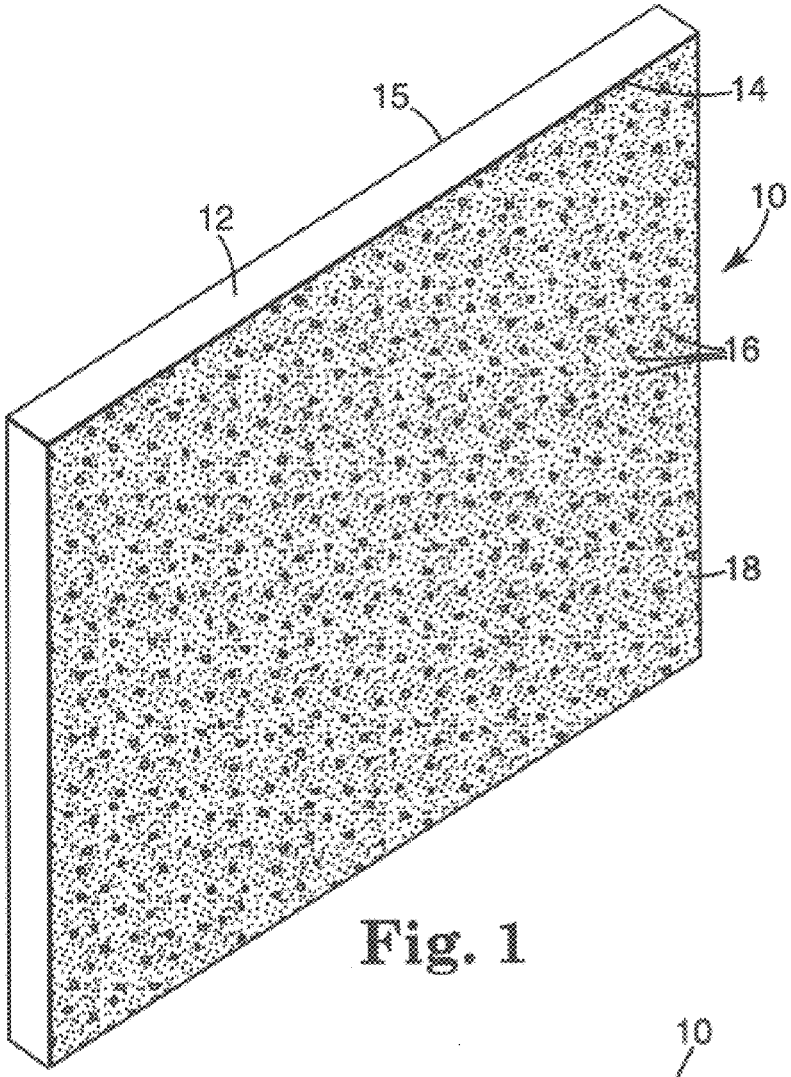
FIG. 1 is a perspective view of a first embodiment of a sanding sponge according to the present invention.
Figure 2:
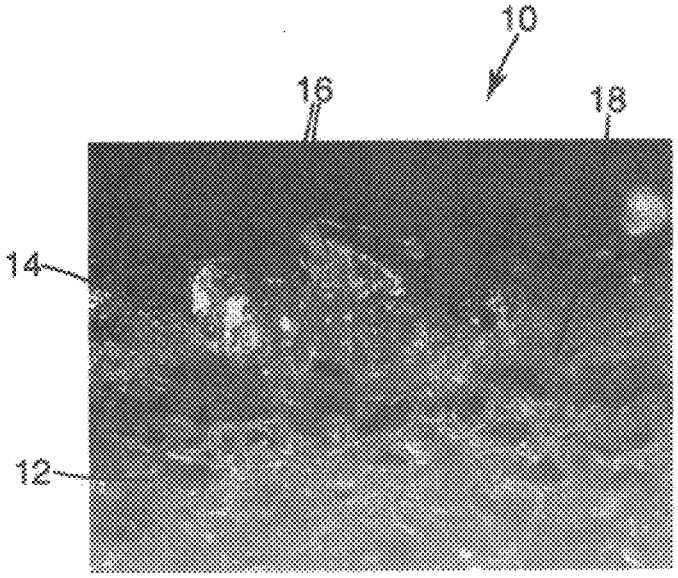
FIG. 2 is a colored photograph of a fragment of the sanding sponge of FIG. 1 taken at 50 times magnification along one side of the sanding sponge.

Referring now to FIGS. 1 and 2 of the drawing, there is illustrated a first embodiment of a resilient flexible sanding sponge according to the present invention generally designated by the reference numeral 10.

Generally the sanding sponge 10 comprises a backing layer 12 of high tear strength felted urethane foam having opposite major surfaces 14 and 15; a layer of abrasive particles 16 distributed along its major surface 14, and a layer 18 of flexible adhesive material adhering the abrasive particles 16 together and to the backing layer 12. A layer of hard anti-loading size coating (not shown) extends over the surfaces of the layer 18 of flexible adhesive and the abrasive particles 16 opposite the backing layer 12. As can be seen in FIG. 2, a major structurally sound portion of the layer 18 of flexible adhesive extends below the surface 14 of the backing layer 12. By "major portion" we mean that more than half the thickness of the layer 18 of flexible adhesive is below the surface 14 of the backing layer 12. We estimate from observation that about 60 to 80 percent of the thickness of the layer 18 of flexible adhesive is below the surface 14 of the backing layer 12. That major portion of the layer 18 of flexible adhesive below the surface 14 of the backing layer 12 is firmly adhered to the cell walls of the foam backing layer 12 and has very few voids that could weaken its structural integrity. Thus, that major portion of the layer 18 of flexible adhesive below the surface 14 of the backing layer 12 together with the minor portion of the layer 18 of flexible adhesive above the surface 14 of the backing layer 12 provide the needed integrity for the layer 18 of flexible adhesive so that it will not break as it is flexed to conform to a surface as the sanding sponge 10 is used. That major portion of the layer 18 of flexible adhesive below the surface 14 of the backing layer 12 provides the needed firm adhesion of the layer 18 of flexible adhesive to the foam backing layer 12 so the it will not release from the foam backing layer 12 as the sanding sponge 10 is flexed to conform to various surfaces while abrading them. The minor portion of the layer 18 of flexible adhesive above the surface 14 of the backing layer 12 provides needed firm adhesion of the layer 18 of flexible adhesive to the abrasive particles 16 that is required so that the abrasive particles 16 will not release from the layer 18 of flexible adhesive as the sanding sponge 10 is used, while still leaving major portions of the abrasive particles 16 projecting above the layer 18 of flexible adhesive material where they can effectively engage and abrade a surface over which the sanding sponge 10 is rubbed.

The felted urethane foam used for the backing layer 12 is formed by compressing one or more layers of heated urethane foam (a thermoplastic foam) in a first direction to reduce the thickness of the layers and provide a desired density for the foam. Felted polyurethane foam is available from Crest Foam Industries, Inc., Moonachie, N.J., in a range of compression ratios at least including from 2 to 10 (i.e., the compression ratio of the felted foam is the ratio of the thickness of the foam before it is compressed to the thickness of the foam after it is compressed). Non-reticulated felted urethane foam having a compression ratio of 3 (e.g., felted urethane foam obtained from Crest Foam Industries, Inc., Moonachie, N.J., under the trade designation "Felt 7018 NAT N/R 0.3450/0.118×46×56") has been found to work well as the backing layer 12 of the sanding sponge 10, as it both provides the desired combination of softness and tear strength while allowing or causing the major structurally sound portion of the layer 18 of flexible adhesive material to be formed below its surface 14, apparently by wicking the adhesive material when it is applied as a liquid into several layers of cells below the surface of the backing layer 12. Felted foams having other lower or higher compression ratios (e.g., 2, 4, or 5) should also be useful. Felted urethane foams with lower compression ratios are more flexible and less expensive than those with a compression ratio of 3 but offer less tear resistance and may not as readily wick in the layer 18 of flexible adhesive. Presumably the tear resistance and ability to wick in a major structurally sound portion of the layers of flexible adhesive increases for felted urethane foams with higher compression ratio numbers, but such felted urethane foams also become more stiff and more expensive as their compression ratios increase.

The backing layer 12, when made of felted urethane foam with a compression ration of 3, should be less than one half inch (1.27 cm) thick, and preferably is about three sixteenths inch (0.5 cm) thick between its opposite major surfaces so that it will be sufficiently flexible to conform to the contour of surfaces to be abraded by the sanding sponge 10.

The abrasive particles 16 can be any of the abrasive particles described in U.S. patent application Ser. No. 09/116,038 filed Jul. 15, 1998, (the content were of is incorporated herein by reference) particularly including particles of aluminum oxide, ceramic, or silicon carbide in the range of about 36 to 400 grit.

The layer 18 of flexible adhesive material that bonds the layer of abrasive particles 16 together and to the backing layer 12 should firmly adhere the abrasive particles 16 together and to that backing layer 12 while being sufficiently flexible to conform with the backing layer 12 to the contour of surfaces to be abraded by the sanding sponge 10. A make coat adhesive formulation and method of applying it described in U.S. patent application Ser. No. 09/116,038 filed Jul. 15, 1998, (the content were of is incorporated herein by reference) can be used to form that layer 18 of flexible adhesive. That make coat adhesive formulation will be wicked into and adsorbed in a backing layer 12 of felted urethane foam with a firmness number of 3 so that a major portion of the layer of flexible adhesive formed is below its surface 14, presumably because of the small cell size and crushed cell walls of the felted foam. This adsorption of the adhesive causes the adhesive material to be securely bonded with the layer of felted urethane foam backing material. Wicking of the make coat adhesive into the felted urethane foam backing material as the sanding sponge 10 is made causes the adhesive material to draw backing from around the abrasive particles while leaving meniscuses of the adhesive around the abrasive particles 16 to hold them in place, thereby exposing a high percentage of the abrasive particles 16 for contact with a surface to be abraded. Also, that wicking of the make coat adhesive formulation into the felted urethane foam backing layer 12 as the sanding sponge 10 is made appears to cause most of the abrasive particles 16 to become supported closely along the surface 14 of the backing layer 12 rather than having abrasive particles supported on portions of the layer of adhesive of different thicknesses, thereby providing an outer surface defined by the ends of the abrasive particles 16 opposite the backing layer 12 that is almost as smooth as the surface 14 of the backing layer 12 to which the abrasive particles are adhered.

The layer of hard anti-loading size coating that extends over the surfaces of the layer 18 of flexible adhesive and the abrasive particles 16 opposite the backing layer 12 can be applied using the formulation and method of applying it described in U.S. patent application Ser. No. 09/116,038 filed Jul. 15, 1998.

Figure 3:
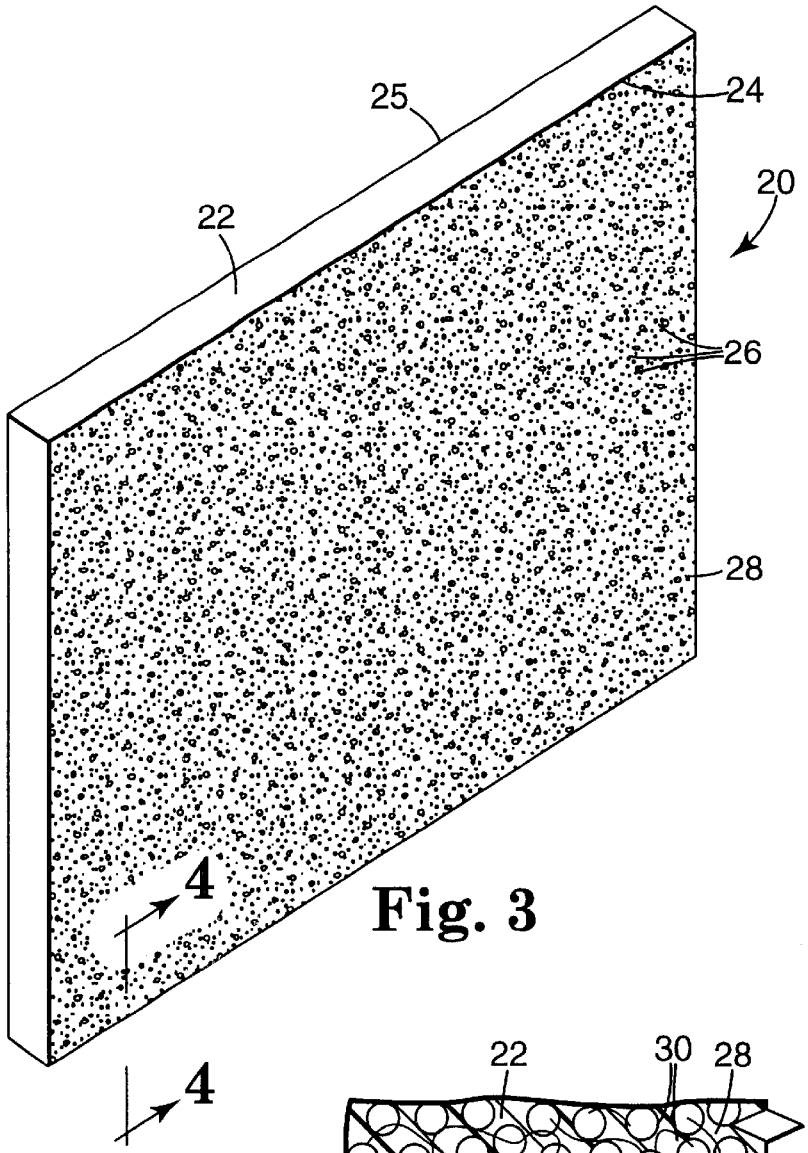
FIG. 3 is a perspective view of a second embodiment of a sanding sponge according to the present invention.
Figure 4:
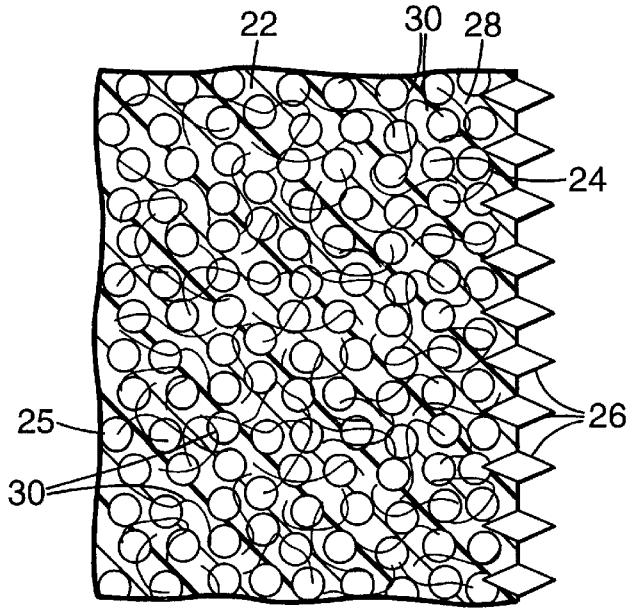
FIG. 4 is an enlarged fragmentary schematic sectional view of the sanding sponge of FIG. 3 taken approximately along line 4—4 of FIG. 3.

Referring now to FIGS. 3 and 4 of the drawing, there is illustrated a second embodiment of a resilient flexible sanding sponge according to the present invention generally designated by the reference numeral 20.

Generally the sanding sponge 20 comprises a backing layer 22 of high tear strength reinforced foam (e.g., urethane foam) having opposite major surfaces 24 and 25, a layer of abrasive particles 26 distributed along its major surface 24, and a layer 28 of flexible adhesive material adhering the abrasive particles 26 together and to the backing layer 22. A layer of hard anti-loading size coating (not shown) extends over the surfaces of the layer 28 of flexible adhesive and the abrasive particles 26 opposite the backing layer 22.

The reinforced foam used for the backing layer 22 is made by forming the foam around (or including within the foam as it is made) strong reinforcing material 30 (e.g., separate metal or polymeric fibers (e.g., nylon) or a porous layer of attached non woven metal or polymeric fibers, or woven metal or polymeric strands (e.g., window screen)) that increases the strength and tear resistance of the foam cast around it. One such reinforced polyurethane foam, available from Fulflex, Inc., Middletown, R.I., under the trade designation "Polycryl 500" which appears to be reinforced by fine denier fibers has been found to work well as the backing layer 22 of the sanding sponge 20.

The reinforced urethane foam backing layer 22 should be less than one half inch (1.27 cm) thick, and preferably is about three sixteenths inch (0.5 cm) thick between its opposite major surfaces 24 and 25 so that it will be sufficiently flexible to conform to the contour of surfaces to be abraded by the sanding sponge 20.

The abrasive particles 26 and the layer 28 of flexible adhesive material that bonds the abrasive particles 26 to the backing layer 22 can be the same as those described above for use in the sanding sponge 10 and or the same as those described in U.S. patent application Ser. No. 09/116,038 filed Jul. 15, 1998, which has been incorporated herein by reference.

Test Results

Comparative tests were performed in accordance with A.S.T.M. test method ASTM D 3574 95 entitled "Standard Test Methods for Flexible Cellular Materials—Slab, Bonded, and Molded Urethane Foams", the content whereof is incorporated herein by reference. Those comparative tests were performed on (1) standard open cell urethane foam of the type currently used as the backing for the sanding sponges currently available from Minnesota Mining and Manufacturing Company, St. Paul, Minn., under the trade designation "Soft-backed Sanding Sponge"; (2) felted urethane foam having a compression ratio of 3 obtained from Crest Foam Industries, Inc., Moonachie, N.J., under the trade designation "Felt 7018 NAT N/R 0.3450/0.118×46×56" which is believed to be a felted urethane foam having 70 cells per inch, a density of 1.8 pounds per cubic foot, natural color, which foam is non-reticulated, has a ratio between its starting and final thicknesses of 0.3450 to 0.118 or 2.92, and comes in a 1 inch thick 46 inch wide by 56 inch long sheet, and (3) reinforced polyurethane foam obtained from Fulflex, Inc., Middletown, R.I., under the trade designation "Polycryl 500" which appears to be foam reinforced by fine denier nylon fibers.

The test results were as follows:

| Foam Tested | Density | CFD 50%* | Comp. Set** | Tensile Strength | Elongation at break | Tear Strength |
|---|---|---|---|---|---|---|
| Standard Urethane | 5.8 lb/ft3 93 kg/m3 | 3.6 psi 58 kpa | 38% | 57 psi 916 kpa | 169% | 3.6 lb/in 625 N/m |
| Felted Foam | 5.4 lb/ft3 86 kg/m3 | 3.4 psi 54 kPa | 26% | 68 psi 1097 kPa | 199% | 7.3 lb/in 1284 N/m |
| Reinforced Foam | 6.9 lb/ft3 110 kg/m3 | 3.5 psi 56 kPa | 32% | 187 psi 2996 kPa | 34% | 18.0 lb/in 3158 N/m |

*compression force deflection, a measure of hardness at 50% compression
**Compression set after 50% deflection Generally, the tear strength is measured by preparing a sample of the foam to be tested 1 inch by 1 inch by 6 inches, cutting a one and one half inch long slit through the sample from one end of the sample to form two one inch by one half inch by one and one half inch long portions adjacent that end of the sample, and then pulling apart those end portions at a steady speed using a force measuring machine to determine the force required to tear apart the test sample beginning at the end of the slit. As can be seen from the test results, the tear strength of the felted urethane foam having a compression ratio of 3 and the tear strength of the fiber reinforced polyurethane foam were both significantly greater than the tear strength of the standard urethane foam, while the conformability of those felted and reinforced foams were similar to the conformability of the standard urethane foam as is indicated by the similar compression force deflection values at 50% deflection for those foams. These results corresponded with our experience that, when abrading projections with sanding sponges made with backing layers of the felted urethane foam and the fiber reinforced foam described above, the backings of those sanding sponges had significantly less tendency to tear than did sanding sponges having backings of standard urethane foam, while having almost the same conformability as sanding sponges having backings of standard urethane foam. From our experience, we would expect that backings, for sanding sponges having a slightly lower tear strength of at least about 5 pounds per inch (880 Newtons per meter) would also provide a significant improvement in tear resistance over prior art sanding sponges .

A 90 degree puncture test was also preformed on (1) standard open cell urethane foam of the type currently used as the backing for the sanding sponges currently available from Minnesota Mining and Manufacturing Company, St. Paul, Minn., under the trade designation "Soft-backed Sanding Sponge"; and (2) felted urethane foam having a compression ratio of 3 obtained from Crest Foam Industries, Inc., Moonachie, N.J., under the trade designation "Felt 7018 NAT N/R 0.3450/0.118×46×56" Both materials were coated with the same amounts of abrasive granules per unit area using the same amounts of liquid make coat adhesive per unit area. Strips 1 inch (2.54 cm) by 6 inches (15.2 cm) were attached to a horizontal plane at one end, had the point of a projection ⅛ inch thick with diverging sides disposed at 90 degrees with respect to each other positioned transversely along their top surfaces sides with the point half way along their lengths and widths, and had their ends opposite that attached to the plane attached to the head of an Instron testing machine which was moved at a right angle to the plane toward the projection at a speed of 10 inches per minute (25.4 cm per minute) and which measured the force required before the projection punctured the sample. The samples of the felted urethane foam were 0.194 inch thick, and the samples of the standard urethane foam were 0.179 inches thick. As an average after testing 6 samples of each material it was found that the Load per thickness at maximum load was 58.6 foot pounds per inch for the felted foam, and 29.94 foot pounds per inch for the standard foam, thus indicating that the felted foam had significantly higher puncture resistance.

The present invention has now been described with reference to two embodiments and possible modifications thereof. It will be apparent to those skilled in the art that many changes can be made in the embodiments described without departing from the scope of the present invention. For example, a rectangular flexible resilient sanding sponge of a known type that has a backing layer that is thicker than that of the sanding sponge described above (e.g., 1 inch or 2.54 cm thick) and has layers of abrasive on 4 or 6 sides adhered to that backing layer by layers of flexible adhesive could be made using a felted foam backing layer or a reinforced backing layer of the types described above to provide high tear strength for that backing layer. It should be possible to make a urethane foam backing layer for a sanding sponge that is both slightly felted and includes reinforcing material to provide a low cost backing layer that has both a desired level of tear strength and will encompass a significant or major portion of the layer of flexible adhesive material. Sanding sponges that are slurry coated (i.e., the abrasive particles and the liquid make coat adhesive are simultaneously coated on the backing layer as a slurry which typically contains proportionally more adhesive than is applied when the adhesive and abrasive particles are separately coated on the backing layer) should be improved by using a backing layer of felted foam because of wicking of the make coat adhesive into the backing layer to better expose the abrasive). Thus, the scope of the present invention should not be limited to the structures described in this application, but only by the structures described by the language of the claims and the equivalents thereof.

What is claimed is:

1. A resilient flexible sanding sponge comprising:

a backing layer of high tear strength felted foam having a major surface;

a layer of abrasive particles distributed along said major surface external to said backing layer; and a layer of flexible adhesive material adhering said abrasive particles together and to said backing layer, said layer of flexible adhesive material including a minor portion of said layer of flexible adhesive material external to said backing layer and around said abrasive particles, and a major structurally sound inner portion of said layer of flexible adhesive material in the backing layer below said major surface, said minor portion of said layer of flexible adhesive material comprising meniscuses of the adhesive around the abrasive particles to hold them in place, thereby exposing a high percentage of the abrasive particles for contact with a surface to be abraded.

2. A sanding sponge according to claim 1 wherein said backing layer is of felted foam having a compression ratio of at least 2.

3. A sanding sponge according to claim 1 wherein said backing layer is of felted urethane foam having a compression ratio of about 3.

4. A sanding sponge according to claim 2 wherein the compression ratio of the felted foam in said backing layer is in the range of about 2 to 4.

5. A sanding sponge according to claim 2 wherein said backing layer is less than one half inch (1.27 cm) thick between said opposite major surfaces.

6. A sanding sponge according to claim 2 wherein said backing layer is about three sixteenths inch (0.5 cm) thick between said opposite major surfaces.

7. A sanding sponge according to claim 1 wherein said backing layer has a tear strength of at least 5 pounds per inch (880 Newtons per meter) when measured in accordance with A.S.T.M. test method D 3574-95.

8. A sanding sponge according to claim 1 wherein said backing layer has a width of about 4.5 inches (11.4 cm) and a length of about 5.5 inches (14 cm) along said major surfaces.

9. A resilient flexible sanding sponge comprising:

a backing layer comprising felted urethane foam having a major surface, said backing layer having a compression force deflection value at 50% deflection of less than 4 pounds per square inch (64 kPa) at 50% deflection and having a tear strength of at least 5 pounds per inch (880 Newtons per meter) when measured in accordance with A.S.T.M. test method D 3574-95;

a layer of abrasive particles distributed along said major surface external to said backing layer; and a layer of flexible adhesive material adhering said abrasive particles together and to said backing layer, said layer of flexible adhesive material including a minor portion of said layer of flexible adhesive material external to said backing layer and around said abrasive particles, and a major structurally sound inner portion of said layer of flexible adhesive material in the backing layer below said major surface, said minor portion of said layer of flexible adhesive material comprising meniscuses of the adhesive around the abrasive particles to hold them in place, thereby exposing a high percentage of the abrasive particles for contact with a surface to be abraded.

10. A sanding sponge according to claim 9 wherein said backing layer of felted urethane foam has a compression ratio of at least 2.

11. A sanding sponge according to claim 9 wherein said backing layer of felted urethane foam has a compression ratio in the range of about 2 to 4.

12. A sanding sponge according to claim 9 wherein said backing layer is less than 0.5 inch or 1.27 cm thick between said opposite major surfaces.

13. A sanding sponge according to claim 9 wherein said backing layer is about 3/16 inch or 0.5 cm thick between said opposite major surfaces.

14. A sanding sponge according to claim 9 wherein said backing layer has a width of about 4.5 inches or 1.4 cm and a length of about 5.5 inches or 14 cm along said major surfaces.

* * * * *